US009576779B2

(12) United States Patent
Guna

(10) Patent No.: US 9,576,779 B2
(45) Date of Patent: Feb. 21, 2017

(54) SYSTEM AND METHOD FOR QUANTITATION IN MASS SPECTROMETRY

(71) Applicant: DH Technologies Development Pte. Ltd., Singapore (SG)

(72) Inventor: Mircea Guna, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/369,480

(22) PCT Filed: Nov. 28, 2012

(86) PCT No.: PCT/IB2012/002520

§ 371 (c)(1),
(2) Date: Jun. 27, 2014

(87) PCT Pub. No.: WO2013/098599

PCT Pub. Date: Jul. 4, 2013

(65) Prior Publication Data

US 2015/0008317 A1 Jan. 8, 2015

Related U.S. Application Data

(60) Provisional application No. 61/581,456, filed on Dec. 29, 2011.

(51) Int. Cl.

| | |
|---|---|
| ***H01J 49/40*** | (2006.01) |
| ***H01J 49/00*** | (2006.01) |
| ***H01J 49/10*** | (2006.01) |

(52) U.S. Cl.

CPC ..... *H01J 49/0045* (2013.01); *H01J 49/004* (2013.01); *H01J 49/0031* (2013.01); *H01J 49/10* (2013.01)

(58) Field of Classification Search

USPC ..... 250/281, 282, 283, 286, 287

See application file for complete search history.

(56) References Cited

U.S. PATENT DOCUMENTS

| | | | | |
|---|---|---|---|---|
| 7,339,163 | B2 | 3/2008 | Marriott | |
| 2002/0117616 | A1* | 8/2002 | Vestal | H01J 49/004 250/287 |

(Continued)

FOREIGN PATENT DOCUMENTS

| | | |
|---|---|---|
| JP | 2006-190526 | 7/2006 |
| JP | 2008-535168 | 8/2008 |

OTHER PUBLICATIONS

International Search Report from International Patent Application No. PCT/IB2012/002520, dated Apr. 29, 2013.

*Primary Examiner* — Nicole Ippolito

(57) ABSTRACT

A method of operating a tandem mass spectrometer system is disclosed including accumulating ions in an ion trap, transmitting a plurality of ions out of the ion trap into a timed-ion selector, applying a pulsed DC voltage to the timed-ion selector, the pulsed DC voltage being modulated to match an ejection time for selecting a first portion of ions from the plurality of ions, corresponding to a specific m/z window, transmitting the first portion of selected ions out of the timed-ion selector into a reaction cell, transmitting dissociation product ions and the remaining ions of the first portion of selected ions out of the reaction cell into a mass analyzer, and mass-selectively transmitting at least some of the fragment ions and the remaining ions of the first portion of selected ions out of the mass analyzer into a detector.

11 Claims, 4 Drawing Sheets

(56) References Cited

U.S. PATENT DOCUMENTS

| | | | | |
|---|---|---|---|---|
| 2006/0113464 | A1 | 6/2006 | Litherland et al. | |
| 2009/0134321 | A1* | 5/2009 | Hoyes | C08L 23/04 250/282 |
| 2011/0049360 | A1 | 3/2011 | Schoen | |

* cited by examiner

SYSTEM AND METHOD FOR QUANTITATION IN MASS SPECTROMETRY

RELATED APPLICATION

This application claims priority to U.S. provisional application No. 61/581,456 filed Dec. 29, 2011, which is incorporated herein by reference in its entirety.

FIELD

The applicant's teachings relate to quantitation in mass spectrometry. More specifically, the applicant's teachings relate to resolution in ion selection.

INTRODUCTION

Selected reaction monitoring (SRM) and its extension, multiple reaction monitoring (MRM), are techniques used for quantification of analytes of low abundance in complex mixtures. SRM exploits the unique capabilities of triple quadrupole mass spectrometry. In an SRM, the first and third quadrupoles act as filters to select predefined precursor ions and fragment ions respectively. The second quadrupole typically serves as a collision cell. Several transitions of precursor/fragment ion pairs are monitored over time, yielding a set of chromatographic traces with the retention time and signal intensity for a specific transition as coordinates.

The accuracy of this analytical technique is defined by the isolation window used to transmit ions through the first and third quadrupoles. Typically, an isolation window of 0.7±0.1 amu is allowed. While these windows provide filtering of co-eluting background ions, matrix-related interferences can occur. Current RF/DC quadrupoles can achieve higher mass resolution of a precursor ion, but with a large loss in ion transmission efficiency.

It is therefore an object of the present teachings to provide a system and method for increasing resolution of the isolation window.

SUMMARY

In accordance with an aspect of the applicant's teachings, there is provided a method operating a tandem mass spectrometer system comprising: accumulating ions in an ion trap; transmitting a plurality of ions out of the ion trap into a timed-ion selector; applying a pulsed DC voltage to the timed-ion selector, the pulsed DC voltage being modulated to match an ejection time for selecting a first portion of ions from the plurality of ions, corresponding to a specific m/z window; transmitting the first portion of selected ions out of the timed-ion selector into a reaction cell to dissociate at least some of the ions of the first portion of selected ions; transmitting dissociation product ions and the remaining ions of the first portion of selected ions out of the reaction cell into a mass analyzer; and mass-selectively transmitting at least some of the fragment ions and the remaining ions of the first portion of selected ions out of the mass analyzer into a detector. In various embodiments, the reaction cell can be a collision cell. In various aspects, the mass analyzer can be a quadrupole mass filter. In various aspects, the mass analyzer can be a second ion trap. In various embodiments, the mass analyzer can be a time-of-flight analyzer. In various embodiments, the mass window can be less than 1 Da wide, or between 0.1 Da and 1 Da or less than 0.1 Da. In various aspects, the mass window can be larger than 1 Da wide and less than 10 Da.

In accordance with another aspect of the applicant's teachings there is provided a method of operating a tandem mass spectrometer system comprising: accumulating ions in an ion trap; transmitting a plurality of ions out of the ion trap into a timed-ion selector; applying a train of pulsed DC voltages to the timed-ion selector, the pulsed DC voltages being modulated to match ejection times for selecting multiple portions of ions from the plurality of ions, the multiple portions of ions corresponding to multiple mass windows at different ejection times; transmitting the first portion of selected ions from the multiple portions of ions out of the timed-ion selector into a reaction cell to dissociate at least some of the ions of the first portion of selected ions into a first portion of product ions, the first portion of selected ions corresponding to a first transmission window; transmitting the first portion of product ions and the first portion of selected ions out of the reaction cell into a mass analyzer; mass-selectively transmitting at least some of the fragment ions and the first portion of selected ions out of the mass analyzer into a detector; transmitting a second portion of selected ions from the multiple portions of ions, out of the timed-ion selector into a reaction cell to dissociate at least some of the ions of the second portion of selected ions into a second portion of product ions, the second portion of selected ions corresponding to a second transmission window; transmitting the second portion of product ions and the second portion of selected ions out of the reaction cell into a mass analyzer; and mass-selectively transmitting at least some of the second portion of product and the second portion of selected ions out of the mass analyzer into a detector. In various aspects, the mass analyzer can be a quadrupole mass filter. In various aspects, the mass analyzer can be a second ion trap. In various embodiments, the mass analyzer can be a time-of-flight analyzer.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in anyway.

In the drawings, like reference numerals indicate like parts.

DESCRIPTION OF VARIOUS EMBODIMENTS

It will be understood that the phrase "a" or "an" used in conjunction with the applicant's teachings with reference to various elements encompasses "one or more" or "at least one" unless the context clearly indicates otherwise. It will be understood by those skilled in the art that the drawings and associated descriptions are intended to be exemplary in nature and are not intended to limit the applicant's teachings in any way.

Figure 1A:
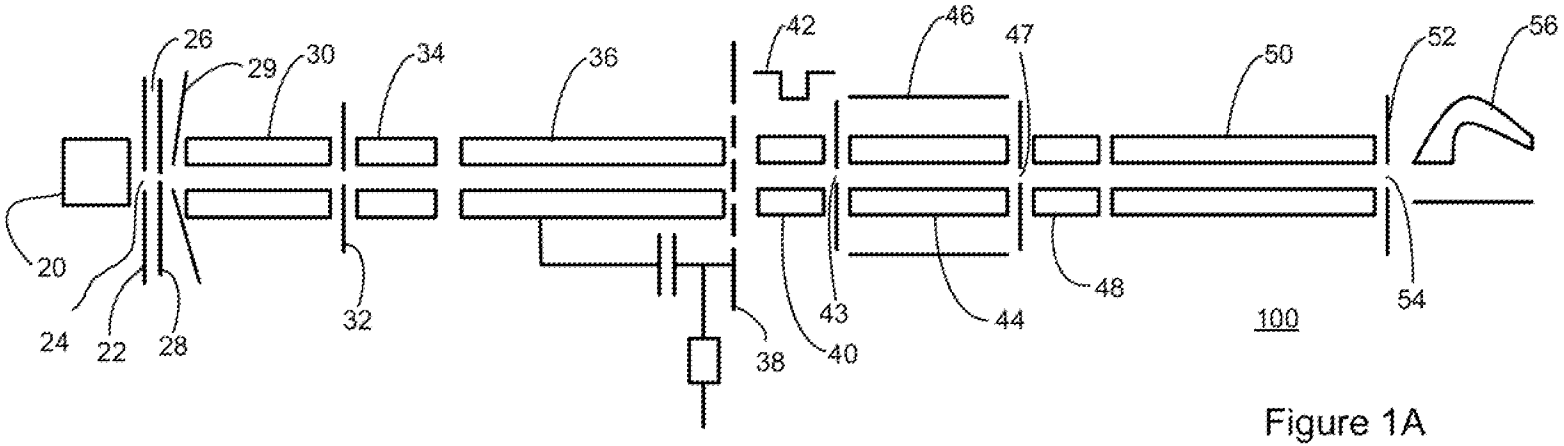
FIG. 1A is a block diagram schematically illustrating an exemplary tandem mass spectrometry system having a timed-ion selector in accordance with various embodiments of the applicant's teachings.

Reference is first made to FIG. 1A which illustrates an exemplary tandem mass spectrometry system generally referred to by the number 100. The tandem mass spectrometry system comprises an ion source 20, which generates and directs a focused ion stream towards a curtain plate 22. In some aspects, the ion source 20 can be an ion spray or electrospray device. Ions passing through an aperture 24 in the curtain plate 22 enter into a curtain chamber 26 formed between the curtain plate 22 and the orifice plate 28. Gas flow in the curtain chamber 24 can reduce the influx of unwanted neutral particles introduced by the ion source 20 through the orifice plate 28.

The mass spectrometer system 100, in this example, comprises four elongated quadrupole rod sets: Q0 30, Q1 36, Q2 44, and Q3 50. In this example, the mass spectrometer system also has interquad lenses IQ1 32, IQ2 43 and IQ3 47 are positioned between the quadrupole rod sets. Three additional sets of RF stubby rods (or Brubaker Lenses) 34, 40, and 48 are provided between IQ1 32 and Q1 36, Q1 36 and IQ2 43, and between IQ3 47 and Q3 50, respectively. When Q1 36 and Q3 50 are operated as RF/DC mass filters, the RF stubby rod sets 34, 40, 48 provide focusing of the ions that enter and exit Q1 36 and Q3 50.

Ions exiting the curtain chamber pass through a skimmer plate 29 into Q0 30 where they are cooled collisionally. Q0 30 can be maintained at a pressure of approximately $8\times10^{-3}$ Torr. In this example, Q0 30 is configured as a linear trap. Alternatively, Q0 30 can be configured to further extract unwanted neutral particles from the ion stream.

Ions exit Q0 30 and exit through an aperture in IQ1 32 and pass through RF stubby rod set 34 into Q1 36, which can be configured as an RF/DC mass filter by applying a combination of quadrupolar RF and direct current (DC) potentials to Q1 36 to selectively stabilize or destabilize ions passing through it. As it is known to those skilled in the art, controlling the amplitude and ratio of RF and DC potentials can destabilize ions having masses that fall outside a range of interest, causing them to be ejected. Q1 36 can also be configured as a linear ion trap. When Q1 36 is configured as a linear ion trap, ions can be trapped in Q1 36 using RF voltages applied to the quadrupole rods and DC voltages applied to the trap exit lens 38. The DC voltage difference between the trap exit lens 38 and the Q1 36 can be used to provide a barrier field.

As described in U.S. Pat. No. 6,177,668, ions trapped within the linear ion trap can be scanned mass-dependently axially out of the Q1 36 and past the DC field applied to the trap exit lens 38 using either dipole or quadrupole excitation. As described in U.S. Patent Publication No. 2003/0189171, ions trapped in a linear quadrupole low-pressure ion trap can be fragmented prior to ejection by resonant excitation. The RF field can be applied to the trap exit lens 37 using coupling capacitors Ce applied to the trap exit lens to increase the extraction efficiency of mass-selective axial ejection (MSAE) of ions out of the Q1 36 trap. In one aspect, this trap exit lens 37 can be a mesh.

MSAE ions of interest pass through to RF stubby rod set 40. In this example, RF stubby rod set 40 is configured as a timed-ion selector (TIS). The pulsed DC voltage 42 applied to the TIS 40 can be applied to eject unwanted ions. The pulsed DC voltage 42 can be, but is not limited, to a quadrupolar voltage or a dipolar voltage. The TIS 40 can be but is not limited to one pair of rods or two pairs of rods that ejects or deflects ions when the pulsed DC voltage 42 is applied. When applied in a quadrupole fashion, the pulsed DC voltage 42 can be mass-dependent and can correspond to the Mathieu parameter a having a value that causes the ion trajectory of the unwanted ion to become unstable in the TIS 40. This pulsed DC voltage 42 can be adjusted in order to match the scan speed and ejection time of the ion of interest. For example, if the scan speed is 25 Da/s, then 0.1 amu window represents 4 ms and thus, the TIS 40 width will be 4 ms wide. The rise time can be adjusted in an order of a few hundredths of microseconds. In normal conditions, the calibration of the Q1 36 is sufficient to predetermine the m/z and thus, the time when the ion of interest exits Q1 36. However, space charge effects can shift the m/z position of the ion of interest, introducing a delay in the exit time of the ions. Typically, the mass shift due to space charge is linear with the number of ions and can be predicted in order to synchronize the TIS 40. A prescan can be performed to determine the timing position (m/z) of the ion of interest.

Because unwanted ions are ejected, only the ions of interest are transferred the quadrupole rod set (Q2) 44 inside a collision cell 46 through collision cell entrance aperture 45. Ions of interest collide with a buffer gas and fragment into product ions of lesser mass. In some cases, Q2 44 can be used as a reaction cell in which ion-neutral or ion-ion reactions occur to generate fragment ions or other types of ions or adducts. Product ions and residual precursor ions exit Q2 44 through IQ3 47 and pass through RF stubby rod set 48 into Q3 50. In some aspects, Q3 50 can be used as a mass filter, allowing specific m/z product ions to be transmitted through the exit lens 52 via its exit lens aperture 54 to a suitable detector 56. In further aspects, Q3 50 can be utilized as a linear ion trap where all product ions are trapped, then after a cooling period, are mass-selectively axially ejected into the detector 56. In still further aspects, Q3 50 can be replaced by a mass analyzer such as a time-of-flight (TOF) mass analyzer.

It will be understood by those in the art that FIG. 1A can have additional elements to complete the mass spectrometry system 100. For example, a plurality of power supplies can be used for delivering DC and RF voltages to different elements of the system 100, such as Q0, Q1, Q2, Q3, IQ3 47, and exit lens 29. In addition a gas pump can be used to maintain pressure levels in different chambers of the system 100 such as the collision cell 46. One or more ion detectors can also be implemented in the system 100.

Figure 1B:
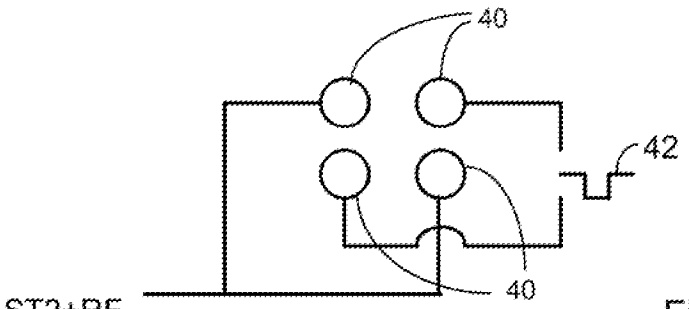
FIG. 1B schematically illustrates the timed-ion selector of FIG. 1A.

FIG. 1B is a cross sectional drawing showing the details and connections of the TIS 40.

Figure 2A:
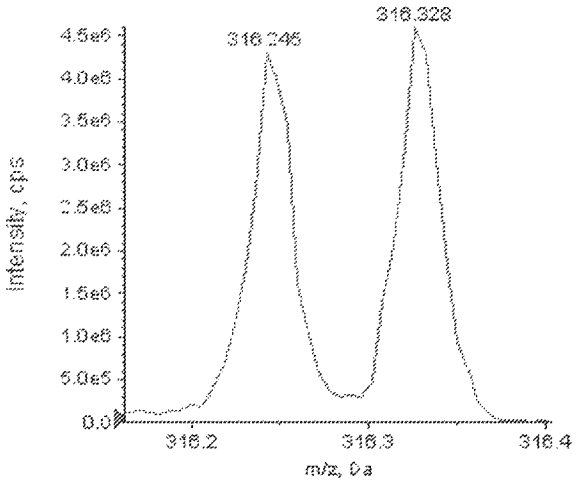
FIGS. 2A-D are exemplary spectra generated by the system of FIG. 1A.
Figure 2B:
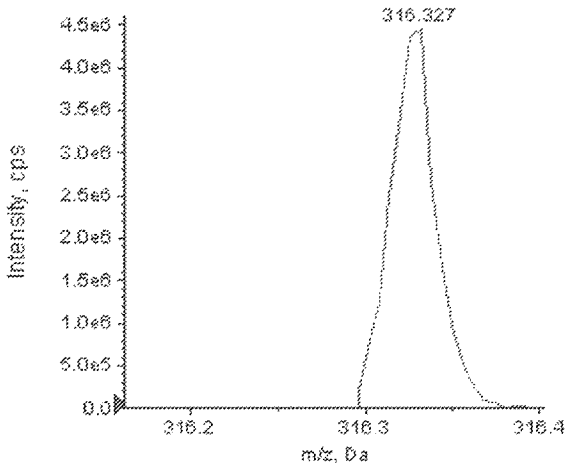
Figure 2C:
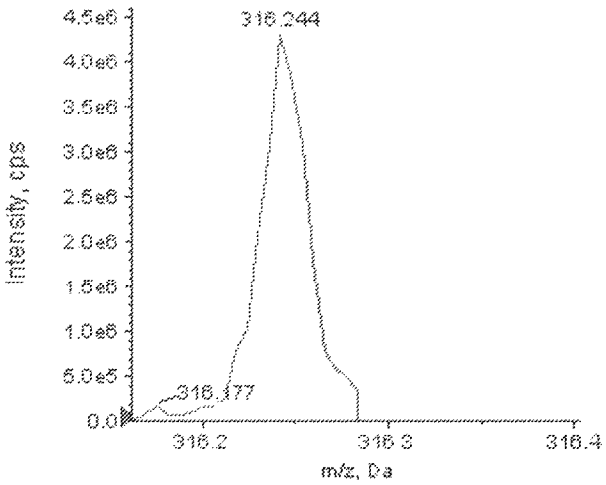
Figure 2D:
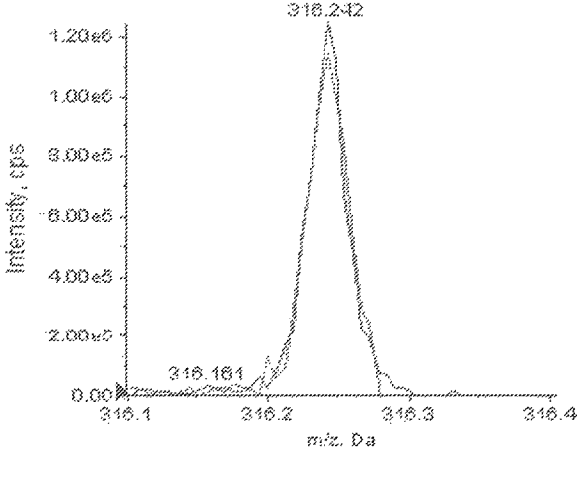

FIG. 2A is an exemplary spectrum of a mixture of bromazepam (316.008 Da, MH+) and flusilazol (316.1076 Da, MH+) ions, using the system of FIG. 1A and is generally referenced by the number 200. This spectrum 200 was acquired at 1 Da/s in forward scanning mode. In this example, the mass spectra are shifted 0.2 Da since the calibration of the LIT was performed at a different scan speed. FIGS. 2B and 2C show LIT spectra when the TIS voltage was timed to either the flusilazol ion or the bromazepam ion respectively. In these experiments the Q3 50 mass filter acted as an ion guide and the collision energy in Q2 44 was sufficient to allow the precursor ions to pass unfragmented through Q2 44. FIG. 2D shows overlapped precursor ion scan spectra of ions that have been mass-selective axially ejected from Q1 36 with and without the TIS voltage applied. In the case of the truncated spectra, the TIS 40 transmitted only ions that exited at times corresponding to the m/z of the bromazepam precursor ion. The transmitted ions were fragmented in the collision cell 46 with a collision energy of 40 eV. The Q3 50 mass filter was set to transmit only the 259 Da fragment ions of the Bromazepam precursor ions. In order to generate an SRM signal, the peak area can be integrated into one data point for each scan. In order to increase selectivity of this high resolution SRM method, the width of the window of m/z ions that are allowed to be transmitted by the TIS 40 could be reduced to just 0.05 Da or less, around the top of the LIT extracted peak with some loss in the peak area.

Ions in mass windows of 1430-1431 Da and 1434-1435 Da are selected. FIG. 2B shows a spectrum 202 where the ions that are scanned out of the trap while the pulsed DC voltage 42 is applied to the TIS 40 for the 1430-1431 Da window. FIG. 2C shows the ions that are scanned out of the trap while the pulsed DC voltage 42 is applied to the TIS 40 for the 1434-1435 Da window.

Figure 3A:
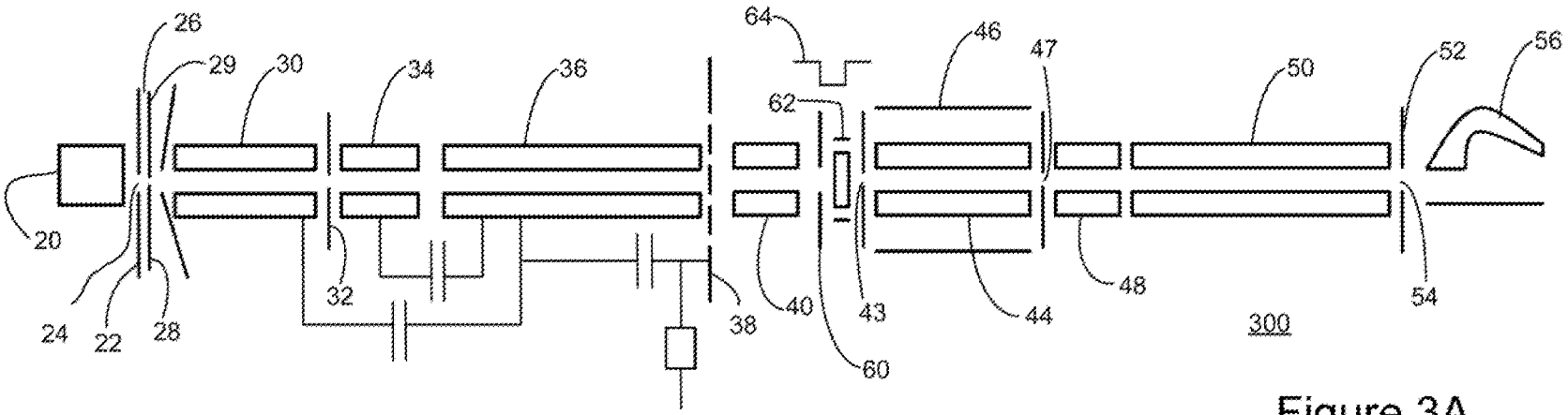
FIG. 3A is a block diagram schematically illustrating an alternative exemplary tandem mass spectrometry system having a timed-ion selector in accordance with various embodiments of the applicant's teachings.

FIG. 3A is an alternate configuration of the mass spectrometry system of FIG. 1A and is generally referenced by the number 300. In this example, lens or interquad barrier 60 is positioned between the stubby rod set 40 and the collision cell 46. Auxiliary electrodes 62 are positioned between interquad barrier 60 and the collision cell 46. In this example, auxiliary electrodes 62 can be a set of four plates arranged in a quadrupole configuration to form a transmission window for the ion beam. Auxiliary electrodes 62 are oriented generally orthogonal to trajectory of the ion beam and are positioned between the interquad barrier 60, such that the electrodes are substantially parallel to the axis of the ion beam. In another example, the auxiliary electrodes 62 can be a top pair of parallel plates and a substantially bottom pair of parallel plates forming a rectangular transmission window. It can be appreciated that other orientations and configurations of the auxiliary electrodes 62 are also possible as long as a transmission of suitable size and shape is defined. For example, plates of different cross-sectional shapes can also be used.

Figure 3B:
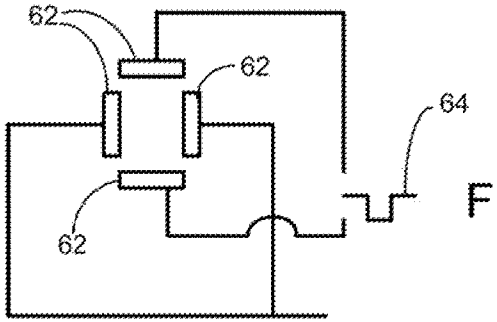
FIG. 3B schematically illustrates the timed-ion selector of FIG. 2A.

FIG. 3B is a cross sectional diagram detailing the auxiliary electrodes of FIG. 3A acting as a TIS. The auxiliary electrodes 60 can be coupled to a controllable voltage source (not shown), which can be configured to provide a pulsed DC voltage 64, i.e. a square wave pulse train.

Turning back to FIG. 3A, application of the pulsed DC voltage 64 to the auxiliary electrodes 60 can establish an ion ejection or deflection field between the electrodes during time intervals when the pulsed DC voltage is high. Unwanted ions are deflected or ejected from the ion beam. Ions of interest are left and transferred to Q2 44.

Figure 4:
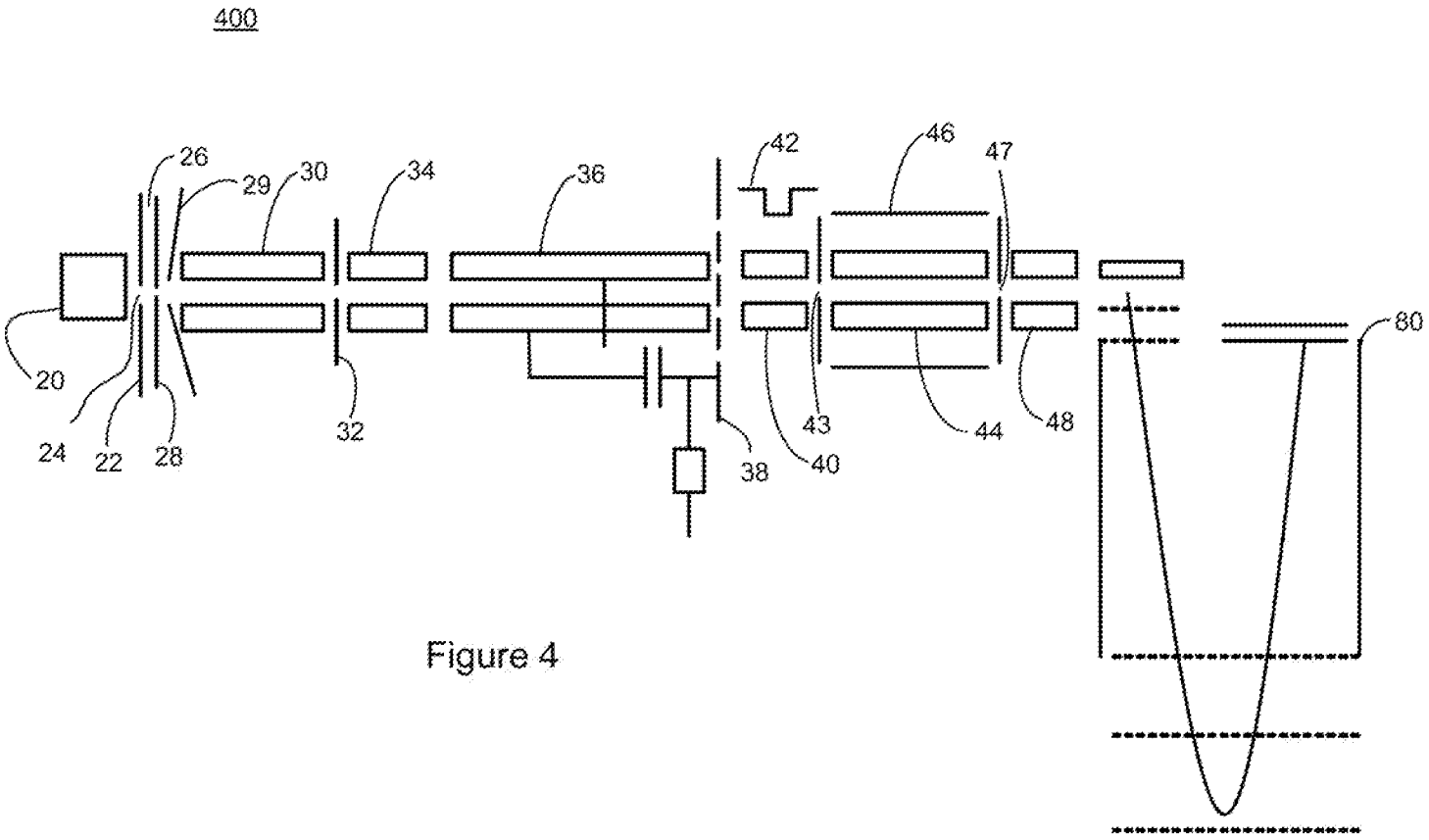
FIG. 4 is a block diagram schematically illustrating the exemplary tandem mass spectrometry system of FIG. 1A in conjunction with a time-of-flight detector in accordance with various embodiments of the applicant's teachings.

FIG. 4 shows another configuration of the mass spectrometry system of FIG. 1A and is generally referenced by the number 400. In FIG. 4, a time-of-flight mass spectrometer 80 replaces Q3 50. In this example, product ions are analyzed by measuring their time of flight.

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those skilled in the art.

In various embodiments, an electrode can be a conducting element on which a potential is provided. An electrode can include, but is not limited to, a plate, ring, rod or tube.

In various embodiments, the mass analyzer can be, but is not limited to, a mass spectrometric instrument which can employ single MS, tandem (MS/MS) or multi-dimensional ($MS^n$) mass spectrometry. Mass spectrometers can include, but are not limited to, a triple quadrupole, an ion trap, a hybrid linear ion trap, a time-of-flight, quadrupole time-of-flight, an RF multipole, a magnetic sector, an electrostatic sector, and an ion mobility spectrometer. Mass analyzers can include, but are not limited to, mass filters, mass selectors, ion focusing and/or ion steering elements, for example, ion guides. Mass analyzers also can include, but are not limited to ion reflectors and/or ion fragmentors, for example, collision cells, photodissociation cells, and surface dissociation fragmentors.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the applicant's teachings have been particularly shown and described with reference to specific illustrative embodiments, it should be understood that various changes in form and detail may be made without departing from the spirit and scope of the teachings. Therefore, all embodiments that come within the scope and spirit of the teachings, and equivalents thereto, are claimed. The descriptions and diagrams of the methods of the applicant's teachings should not be read as limited to the described order of elements unless stated to that effect.

While the applicant's teachings have been described in conjunction with various embodiments and examples, it is not intended that the applicant's teachings be limited to such embodiments or examples. On the contrary, the applicant's teachings encompass various alternatives, modifications, and equivalents, as will be appreciated by those of skill in the art, and all such modifications or variations are believed to be within the sphere and scope of the invention.

What is claimed is:

1. A method of operating a tandem mass spectrometer system comprising:

accumulating ions in a high resolution RF ion trap;

mass selective axial ejecting a plurality of ions out of the ion trap into a timed-ion selector, with high resolution;

applying a pulsed DC voltage to the timed-ion selector, the pulsed DC voltage being modulated to match an ejection time from the ion trap for selecting a first portion of ions from the plurality of ions, corresponding to a specific m/z window;

transmitting the first portion of selected ions out of the timed-ion selector into a reaction cell to dissociate at least some of the ions of the first portion of selected ions into dissociation product ions;

transmitting dissociation product ions and the remaining ions of the first portion of selected ions out of the reaction cell into a mass analyzer; and mass-selectively transmitting at least some of the fragment ions and the remaining ions of the first portion of selected ions out of the mass analyzer into a detector.

2. The method of claim 1 wherein the reaction cell is a collision cell.

3. The method of claim 1 wherein the mass analyzer is a quadrupole mass filter.

4. The method of claim 1 wherein the mass analyzer is a second ion trap.

5. The method of claim 1 wherein the mass analyzer is a time-of-flight analyzer.

6. The method of claim 1 wherein the mass window is less than 1 Da wide, or between 0.1 Da and 1 Da or less than 0.1 Da.

7. The method of claim 1 wherein the mass window is larger than 1 Da wide and less than 10 Da.

8. A method of operating a tandem mass spectrometer system comprising:

accumulating ions in a high resolution RF ion trap;

mass selective axial ejecting a plurality of ions out of the ion trap into a timed-ion selector, with high resolution;

applying a train of pulsed DC voltages to the timed-ion selector, the pulsed DC voltages being modulated to match ejection times from the ion trap for selecting multiple portions of ions from the plurality of ions, the multiple portions of ions corresponding to multiple mass windows at different ejection times;

transmitting the first portion of selected ions from the multiple portions of ions out of the timed-ion selector into a reaction cell to dissociate at least some of the ions of the first portion of selected ions into a first portion of product ions, the first portion of selected ions corresponding to a first transmission window;

transmitting the first portion of product ions and the first portion of selected ions out of the reaction cell into a mass analyzer;

mass-selectively transmitting at least some of the fragment ions and the first portion of selected ions out of the mass analyzer into a detector;

transmitting a second portion of selected ions from the multiple portions of ions, out of the timed-ion selector into a reaction cell to dissociate at least some of the ions of the second portion of selected ions into a second portion of product ions, the second portion of selected ions corresponding to a second transmission window;

transmitting the second portion of product ions and the second portion of selected ions out of the reaction cell into a mass analyzer; and mass-selectively transmitting at least some of the second portion of product and the second portion of selected ions out of the mass analyzer into a detector.

9. The method of claim 8 wherein the mass analyzer is a quadrupole mass filter.

10. The method of claim 8 wherein the mass analyzer is a second ion trap.

11. The method of claim 8 wherein the mass analyzer is a time-of-flight analyzer.

* * * * *